US006269608B1

(12) United States Patent
Porter

(10) Patent No.: US 6,269,608 B1
(45) Date of Patent: Aug. 7, 2001

(54) STRUCTURAL INSULATED PANELS FOR USE WITH 2X STICK CONSTRUCTION

(76) Inventor: William H. Porter, P.O. Box 249, Saugatuck, MI (US) 49453

( * ) Notice: Subject to any disclaimer, the term of this patent is extended or adjusted under 35 U.S.C. 154(b) by 0 days.

(21) Appl. No.: 09/433,992

(22) Filed: Nov. 4, 1999

(51) Int. Cl.[7] ..... E04C 2/26

(52) U.S. Cl. ..... 52/794.1; 52/784.15; 52/797.1; 52/800.11; 52/210; 52/459; 52/481.1; 52/582.1

(58) Field of Search ..... 52/783.1, 784.15, 52/794.1, 797.1, 800.11, 800.12, 800.18, 210, 288.1, 404.1, 459, 481.1, 582.1

(56) References Cited

U.S. PATENT DOCUMENTS

| | | | | |
|---|---|---|---|---|
| 919,057 | | 4/1909 | Moore . | |
| 1,250,594 | | 12/1917 | Knapp . | |
| 2,111,922 | | 3/1938 | Borkenstein . | |
| 2,582,468 | * | 1/1952 | Sylvan | 52/800.18 X |
| 2,815,542 | * | 12/1957 | Baker | 52/238.1 |
| 2,875,478 | | 3/1959 | Andre . | |
| 3,086,328 | * | 4/1963 | Peterson et al. | 52/459 X |
| 3,196,499 | * | 7/1965 | Houvener | 52/794.1 |
| 3,557,840 | | 1/1971 | Maybee . | |
| 3,654,053 | | 4/1972 | Toedter . | |
| 3,665,662 | * | 5/1972 | Timbrook et al. | 52/210 |
| 3,731,449 | | 5/1973 | Kephart, Jr. . | |
| 3,911,554 | | 10/1975 | Ford . | |
| 3,979,869 | * | 9/1976 | Beehler | 52/800.18 X |
| 4,024,684 | | 5/1977 | Holmgren . | |
| 4,037,377 | | 7/1977 | Howell et al. . | |
| 4,051,641 | | 10/1977 | Elliott . | |
| 4,068,437 | | 1/1978 | Byxbe et al. . | |
| 4,147,004 | | 4/1979 | Day et al. . | |
| 4,169,688 | | 10/1979 | Toshio . | |
| 4,170,859 | | 10/1979 | Counihan . | |
| 4,402,170 | | 9/1983 | Seidner . | |
| 4,430,833 | | 2/1984 | Balzer et al. . | |
| 4,443,988 | | 4/1984 | Coutu, Sr. . | |
| 4,471,591 | | 9/1984 | Jamison . | |
| 4,578,909 | * | 4/1986 | Henley et al. | 52/210 X |
| 4,671,038 | | 6/1987 | Porter . | |
| 4,704,837 | | 11/1987 | Menchetti et al. . | |
| 4,726,973 | | 2/1988 | Thompson . | |
| 4,765,105 | | 8/1988 | Tissington et al. . | |
| 4,786,547 | | 11/1988 | St-Michel . | |
| 4,856,244 | | 8/1989 | Clapp . | |
| 4,865,912 | | 9/1989 | Mitsumata . | |

(List continued on next page.)

*Primary Examiner*—Beth A. Stephan
*Assistant Examiner*—Brian E. Glessner
(74) *Attorney, Agent, or Firm*—Emrich & Dithmar

(57) ABSTRACT

Structural insulated panels having an inner insulating core and first and second outer facings disposed on opposed surfaces of the insulating core are securely attached to a structural member such as 2X stick structural members in a building structure. A strip of tape is wrapped around the structural member and opposed ends of the tape strip are adhesively bonded to the opposed outer facings of the panel. The tape strip may extend the full height or width of the panel to provide a secure, environmentally sealed connection between the panel and the structural member. An adhesive bonding agent may be inserted between an edge of the panel and the structural member to further increase the strength of the connection between the panel and structural member. The panel's edge may be provided with a C-shaped metal channel for more securely attaching the panel to the structural member by means of nails or screws driven through opposed ends of the tape strip and into the metal channel within the panel. The structural insulated panel is provided with smooth, continuous outer facings for improved bonding between the panel and the tape strip which is preferably a high strength, flexible, self-adhering structural tape. The tape connection arrangement may also be used to connect adjacent panels in an edge-to-edge abutting manner as well as in the installation of a narrow filler structural insulated panel disposed between adjacent 2X dimensional structural members.

18 Claims, 2 Drawing Sheets

U.S. PATENT DOCUMENTS

| | | | | |
|---|---|---|---|---|
| 4,932,171 | | 6/1990 | Beattie . | |
| 5,058,333 | | 10/1991 | Schwartz . | |
| 5,062,250 | | 11/1991 | Buzzella . | |
| 5,081,810 | | 1/1992 | Emmert . | |
| 5,140,086 | | 8/1992 | Hunter et al. . | |
| 5,345,738 | | 9/1994 | Dimakis . | |
| 5,428,929 | | 7/1995 | Reese . | |
| 5,497,589 | | 3/1996 | Porter . | |
| 5,628,158 | | 5/1997 | Porter . | |
| 5,638,651 | | 6/1997 | Ford . | |
| 5,706,626 | * | 1/1998 | Mueller | 52/800.12 |
| 5,842,314 | | 12/1998 | Porter . | |
| 5,950,389 | | 9/1999 | Porter . | |
| 5,953,883 | | 9/1999 | Ojala . | |

* cited by examiner

STRUCTURAL INSULATED PANELS FOR USE WITH 2X STICK CONSTRUCTION

FIELD OF THE INVENTION

This invention relates generally to structural insulated panels as used in building construction and is particularly directed to a coupling arrangement for connecting structural insulated panels to 2X stick structural members.

BACKGROUND OF THE INVENTION

Most houses built today employ lumber stick construction using 2X dimensional structural lumber members and nails. The 2X4 structural lumber member is the most common element of this type of building construction. Another construction approach gaining increased acceptance involves the use of Structural Insulated Panels (SIPs) comprised of a generally planar inner insulating core and first and second outer facings attached to opposed surfaces of the insulating core. Even SIP construction makes use of the 2X stick construction approach for standard openings in the building such as for window and door openings and, in particular, the base and top plates of these types of openings. SIPs are best used in uninterrupted areas without openings requiring cutouts. Providing openings and odd cuts in a SIP requires rather precise cutting of the SIP to form a groove in the panel which is adapted to receive a 2X dimensional structural lumber member. This procedure is labor intensive and thus increases the cost and time of construction. There is therefore a need to make structural insulated panels more readily adapted for use in 2X dimensional lumber construction.

This invention addresses the aforementioned limitations of the prior art by providing a structural insulated panel with an overall thickness the same as that of 2X dimensional structural lumber members and a panel connecting arrangement which facilitates installation of the panel in structures employing 2X lumber stick construction.

OBJECTS AND SUMMARY OF THE INVENTION

Accordingly, it is an object of the present invention to provide a secure, sealed connection between a structural insulated panel and a 2X stick structural member.

It is another object of the present invention to provide an easily assembled, environmentally sealed, high strength connection between a 2X stick structural member and a structural insulated panel without requiring modification of the panel.

A further object of the present invention is to provide an insulation arrangement for a structural insulated panel in a building structure which is particularly adapted for use in window and door openings including base and top plates.

A still further object of the present invention is to provide an easily assembled, environmentally sealed, high strength connection between adjacent structural insulated panels arranged in edge-to-edge abutting contact.

This invention contemplates a structural panel connecting arrangement comprising a generally planar structural insulated panel having an inner insulating core with opposed first and second outer surfaces and first and second outer facings respectively disposed on said first and second outer surfaces of said insulating core; an elongated, linear 2X stick structural member; and an adhesive member disposed about and adhesively bonded to said 2X stick structural member, the adhesive member including first and second opposed ends adhesively bonded to the first and second outer facings of the structural insulated panel, respectively.

This invention further contemplates a structural panel connecting arrangement comprising a generally planar first structural insulated panel having an inner insulating core and first and second facings disposed on opposed outer surfaces of the insulating core; a generally planar second structural insulated panel having an inner insulating core and first and second facings disposed on opposed outer surfaces of the insulating core, wherein the first and second structural insulated panels are arranged in edge-abutting contact; and first and second tape strips disposed over the adjacent edges of the first and second structural insulated panels and adhesively engaging the first facings and the second facings, respectively, of the first and second structural insulated panels for securely connecting the first and second structural insulated panels in a sealed manner.

BRIEF DESCRIPTION OF THE DRAWINGS

The appended claims set forth those novel features which characterize the invention. However, the invention itself, as well as further objects and advantages thereof, will best be understood by reference to the following detailed description of figures, in which:

DETAILED DESCRIPTION OF PREFERRED EMBODIMENTS

Figures 1, 2:
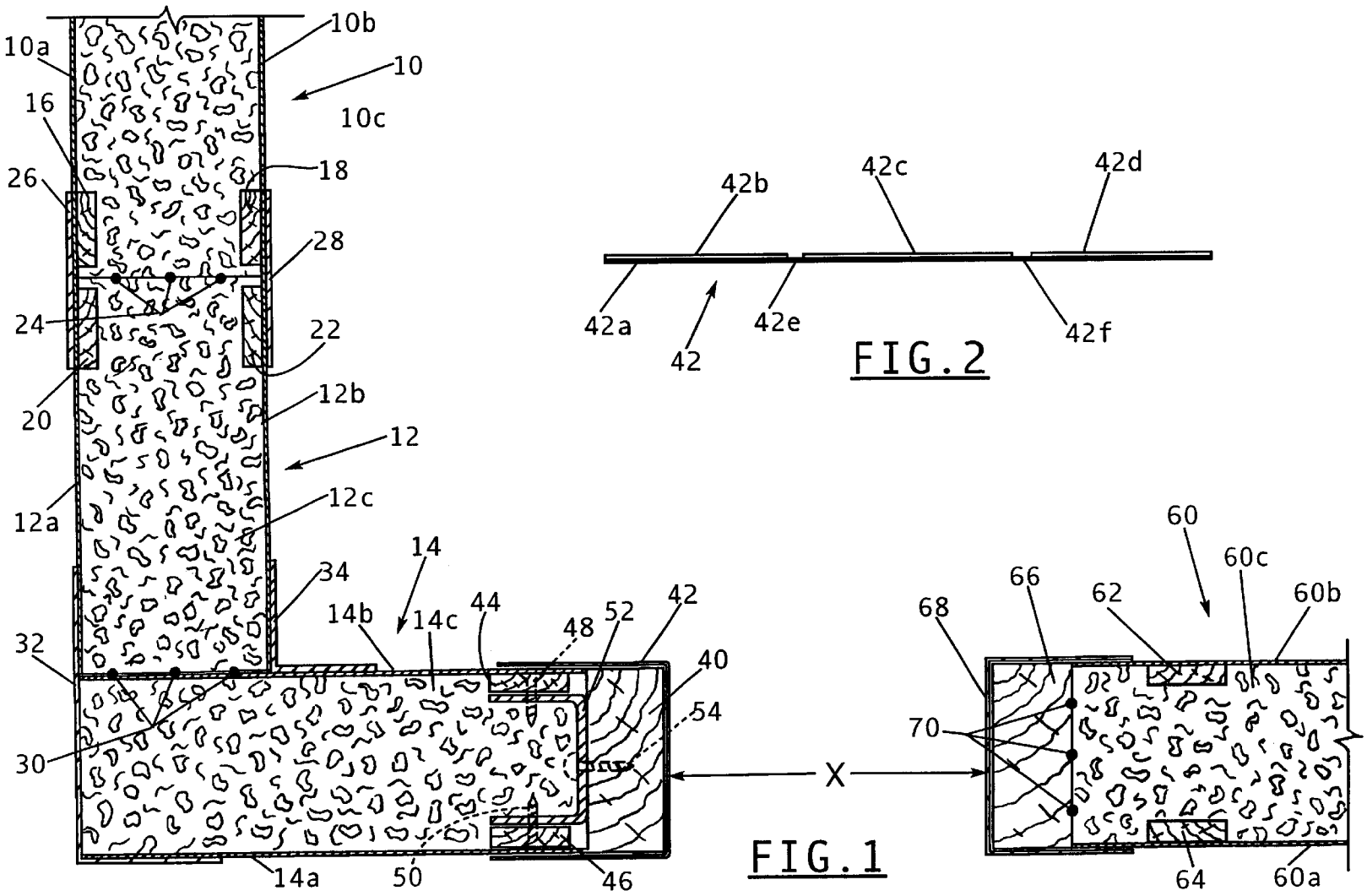
FIG. 1 is a sectional view showing the manner in which several structural insulated panels are connected together as well as to 2X structural lumber members so as to form an opening in a wall such as for a window or doorway in accordance with one aspect of the present invention.
FIG.2 is an end-on view of a strip of tape used in attaching a structural insulated panel to a 2X dimensional structural lumber member in accordance with another aspect of the present invention.

Referring to FIG. 1, there is shown a sectional view of first, second, third and fourth structural insulated panels 10, 12, 14, and 60 showing the manner in which several of these panels are connected together as well as attached to first and second 2X stick structural member 40 and 66 in accordance with the present invention.

The first structural insulated panel 10 includes an insulating core 10*c* and first and second outer facings 10*a* and 10*b* attached to opposed surfaces of the panel's insulating core. In the first structural insulated panel 10, as well as in the other structural insulated panels discussed in detail below, the panel's insulating core is preferably comprised of a plastic foam or an agricultural product such as strawboard or wheatboard. Plastic foam used for the panel's insulating core 10*c* is preferably to be comprised of expanded polystyrene or urethane. The panel's first and second outer facings 10*a*, 10*b* may be comprised of a conventional material such as gypsum or cementous composite, oriented strand board (OSB), drywall, exterior siding or other rigid construction boards from ¼" to ¾" thick. Recent structural insulated panel designs have included outer facings of plastic impregnated paper comprised of paper or box board impregnated with a plastic such as urethane, polystyrene or polyisocyanurate. Any of the more conventional adhesive materials such as urethane or epoxy cement, glue or a mastic coating may be used for bonding the panel's first and second outer facings 10*a*, 10*b* to its inner insulating core 10*c*.

The second structural insulated panel 12 is similarly comprised of an inner insulating core 12*c* and the first and second outer facings 12*a* and 12*b* attached to respective opposed surfaces of the panel's insulating core. Disposed within the insulating core 10*c* of the first structural insulated panel 10 and attached respectively to its first and second outer facings 10*a*, 10*b* are first and second struts 16 and 18. Similarly, disposed within the insulating core 12*c* of the second structural insulated panel 12 and respectively bonded to the panel's first and second outer facings 12*a*, 12*b* are third and fourth struts 20 and 22. Each of the aforementioned struts is in the form of an elongated, linear structural member and may be comprised of either a metal such as steel or wood. The struts serve to reinforce and strengthen the panel as well as facilitate attachment of the panel to a building structural member and further facilitate attachment of an outer facing to the structural insulated panel. A conventional adhesive material may be used to bond each of the struts to the structural insulated panel's insulating core as well as to an outer facing of the panel.

In accordance with the present invention, the first and second structural insulated panels 10, 12 are securely connected together in an edge-abutting manner by means of first and second tape strips 26 and 28 disposed over the juncture between the two panels in an overlapping manner. The bond between the first and second structural insulated panels 10, 12 is further strengthened by means of mastic beads 24 deposited between the abutting edges of the two panels. The first and second tape strips 26, 28 are preferably comprised of a pressure sensitive tape such as duct tape. The mastic beads 24 provide high shear strength, while the first and second tape strips 26, 28 provide high tensile strength for the connection between the first and second structural insulated panels 10, 12. The outer facings of the joined panels preferably provide a smooth, continuous surface for improved bonding with the tape strips. The aforementioned plastic or resin impregnated paper outer facings on the panel provide a particularly good bonding surface for the connecting tape strips.

As in the case of the first and second structural insulated panels 10, 12, the third structural insulated panel 14 includes an inner insulating core 14c and first and second outer facings 14*a* and 14*b* attached to opposed outer surfaces of the panel's insulating core. An edge of the second structural insulated panel 12 is connected to a lateral portion of the third structural insulated panel 14 by means of third and fourth tape strips 32 and 34 attached to adjacent surfaces of these panels. The bond between the second and third insulating panels 12, 14 is further strengthened by means of mastic beads 30 disposed between these two panels. The third tape strip 32 is placed in contact with and adhesively bonded to adjacent outer surfaces of the second and third structural insulated panels 12, 14. The third tape strip 32 is wrapped around a corner of the third structural insulated panel 14 to further increase the strength of the connection between the second and third panels. The fourth tape strip 34 is also bent at an angle of 90° to conform with the adjacent surfaces of the abutting second and third structural insulated panels 12, 14. Again, each of the third and fourth tape strips 32, 34 is preferably of the self-adhering tape type and of high strength.

Disposed within the insulating core 14*c* of the third structural insulated panel 14 are fifth and sixth struts 44 and 46. The fifth and sixth struts 44, 46 are respectively bonded to the second and first outer facings 14*b* and 14*a* of the third structural insulated panel 14. Each of these struts is further bonded to the panel's insulating core 14*c*. A C-shaped channel 52 preferably comprised of a high strength metal is inserted in the panel's insulating core 14*c* and is disposed immediately adjacent to or in contact with the fifth and sixth struts 44, 46. A first connecting pin 48 (shown in dotted line form) is inserted through the panel's second outer facing 14*b* and through the fifth strut 44. Similarly, a second connecting pin 50 (also shown in dotted line form) is inserted through the panel's first outer facing 14*a* and the sixth strut 46. Each of the connecting pins 48, 50 may be in the form of either a screw or a nail and extends into the panel's insulating core 14*c*. The C-shaped channel 52 increases the strength of the third structural insulated panel 14 and facilitates attachment of the panel to a first 2X stick structural member 40 as described below. The third connecting pin 54 is inserted through the C-shaped channel 52 and into the first 2X structural member 40.

In accordance with another aspect of the present invention, a tape strip 42 is wrapped around the first 2X structural member 40 and the two opposed ends of the tape strip are placed in intimate contact with the first and second outer facings 14*a*, 14*b* of the third structural insulated panel 14. FIG. 2 is an end-on view of the tape strip 42 shown in a flat configuration. Tape strip 42 includes an adhesive backed member 42*a* and first, second, and third release paper sections 42*b*, 42*c* and 42*d*. Release paper sections 42*b*, 42*c*, 42*d* are first removed from the adhesive backed member 42*a* of the tape strip 42 to expose the strip's sticky surface. The center portion of the tape strip 42 is then applied to the first 2X stick structural member 40. The tape strip 42 is then folded along spaced first and second bend lines 42e and 42f, with the two end portions of the tape strip securely affixed to respective opposed sides of the first 2X stick structural member 40 as well as to the outer facings of the third structural insulated panel 14. Tape strip 42 provides a secure connection between the edge of the third structural insulated panel 14 and the first 2X stick structural member 40 and also forms a sealed, moisture-resistant and environmentally sealed connection between the structural insulated panel and the 2X stick structural member. Even though the tape strip 42 does not adhere particularly well to a 2X lumber stick structural member, looping the high strength tape strip around the structural member provides a high strength bond between the structural member and the structural insulated panel. An adhesive may also be applied between the first 2X stick structural member 40 and the end of the third structural insulated panel 14 further increasing the strength of the connection between these two structural members, although this is not shown in the figure for simplicity.

Also shown in the sectional view of FIG. 1 is a fourth structural insulated panel 60 connected to a second 2X stick structural member 66 in accordance with the present invention. As in the case of the previously described panels, the fourth structural insulated panel 60 includes an insulating core 60*c* and first and second outer facings 60*a* and 60*b* attached to respective opposed surfaces of the panel. Disposed within the fourth structural insulated panel 60 and respectively bonded to the panel's first and second outer facings 60*a*, 60*b* as well as to the panel's insulating core 60*c* are first and second internal struts 62 and 64. Mastic beads 70 are disposed between the edge of the panel's insulating core 60*c* and the second 2X stick structural member 66 for securely bonding the fourth structural insulated panel 60 to the 2X stick structural member. Also in accordance with the present invention, a tape strip 68 is looped around and adhered to the second 2X stick structural member 66, with opposed ends of the tape strip placed in contact with and adhered to the first and second outer facings 60*a*, 60*b* of the fourth structural insulated panel 60. The distance "X" shown in FIG. 1 represents the width or height of an opening in a wall such as for a window or doorway. The tape strip coupling arrangement for structural insulated panels of the present invention is thus particularly adapted for use adjacent openings in a wall of the structure for attaching the panel to a 2X structural member in a plate, jamb or header. A moisture and weather resistant seal provided by the panel mounting arrangement of the present invention is particularly important around openings in the outer walls of the building structure such as in the case of windows and doorways.

Figure 3:
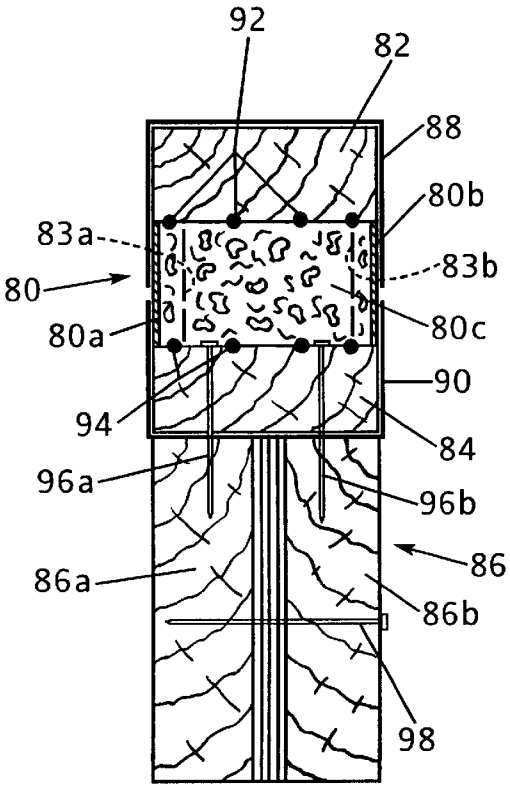
FIG. 3 is a sectional view showing an arrangement for installing a narrow filler structural insulated panel between a pair of spaced 2X dimensional structural lumber members such as in the top or base plate of a window or doorway in accordance with another aspect of the present invention.

Referring to FIG. 3, there is shown a sectional view of another arrangement for connecting a filler structural insulated panel 80 to a pair of spaced 2X stick structural members. In FIG. 3, filler structural insulated panel 80 is shown disposed between and attached to a 2X top plate 82 and a 2X stick structural member 84. The filler structural insulated panel 80 is in the general form of an elongated, linear strip and has a width of 2X dimension to match the width of the 2X stick structural member that it is to be used with. The filler structural insulated panel 80 is placed between and in intimate contact with adjacent 2X stick structural members such as for insulating around a door or window opening. As in the previously described embodiments, filler structural insulated panel 80 includes an insulating core 80c and first and second outer facings 80a and 80b disposed on opposed surfaces of the insulating core. Also included in the filler structural insulated panel 80 and shown in dotted line form in the figure are first and second internal struts 83*a* and 83*b* disposed within the panel's insulating core 80*c*. The first and second struts 83*a*, 83*b* are respectively disposed in contact with and bonded to the panel's first and second outer facings 80*a* and 80*b* by a conventional adhesive material. An upper edge of the filler structural insulated panel 80 is bonded to the top plate 82 by mastic beads 92. Similarly, a lower surface of the filler structural insulated panel 80 is bonded to an upper portion of the 2X stick structural member 84 by mastic beads 94. To further increase the structural strength of the bonded combination of the filler structural insulated panel 80, top plate 82 and 2X stick structural member 84, a first tape strip 88 is wrapped around and adhered to the structural insulated panel and the top plate. Opposed ends of the first tape strip 88 engage and adhere to the first and second outer facings 80*a*, 80*b* of the filler structural insulated panel 80. Similarly, a second tape strip 90 is wrapped around the combination of the 2X stick structural member 84 and filler structural insulated panel 80. Opposed ends of the second tape strip 90 engage and adhere to the first and second outer facings 80*a*, 80*b* of the filler structural insulated panel 80. This combination of bonded structural members provides a high strength structure for use with a conventional window header 86, where the window frame is insulated from the top plate 82 in the outer wall of the building structure. The window header 86 includes first and second 2X stick structural members 86*a* and 86*b* which are connected together by means of a first connecting pin 98, such as a nail. Second and third connecting pins 96*a* and 96*b* connect the 2X stick structural member 84 to the window header 86. Top plate 82 is thus securely connected to the window header 86 in a secure manner that provides thermal insulation between the top plate and the window header.

Figure 4:
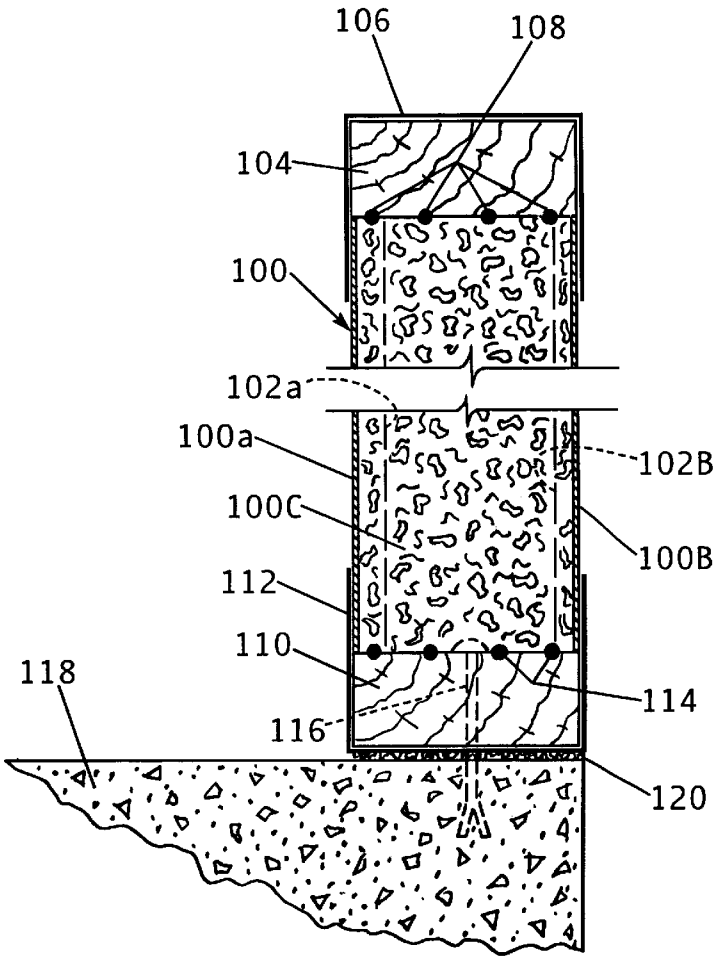
FIG. 4 is a sectional view showing the manner in which the upper and lower edges of a structural insulated panel are respectively connected to top and base plates such as in a wall in accordance with another aspect of the present invention.

Referring to FIG. 4, there is shown a sectional view of a coupling arrangement for connecting a structural insulated panel 100 to a 2X stick sill plate 104 and a 2X stick base plate 110 in accordance with another aspect of the present invention. As in the previously described structural insulated panels, structural insulated panel 100 includes an insulating core 100*c*, first and second outer facings 100*a* and 100*b* attached to two respective facing portions of the insulating core, and first and second internal struts 102*a* and 102*b*, which are shown in the figure in dotted line form. The first and second internal struts 102*a*, 102*b* are attached to the panel's insulating core 100*c* as well as to the first and second outer facings 100*a*, 100*b*, respectively, by means of an adhesive bonding material as previously described. The first and second internal struts 102*a*, 102*b* increase the tensile and bending strength of the structural insulated panel 100 as well as facilitate attachment of outer facings to the panel and mounting of the panel in a building structure. Disposed on the upper edge of the structural insulated panel 100 and bonded to the panel by means of mastic beads 108 is the 2X stick sill plate 104. Wrapped around and adhesively bonded to the sill plate 104 is a first tape strip 106. Opposed ends of the first tape strip 106 are adhesively bonded to the panel's first and second outer facings 100*a*, 100*b*. Bonded to the lower edge of the structural insulated panel 100 by means of mastic beads 114 is the base plate 110. A second tape strip 112 is wrapped around and adhesively bonded to the base plate 110. Opposed ends of the second tape strip 112 are adhesively bonded to the panel's first and second outer facings 100*a*, 100*b*. The structural insulated panel and sill and base plate combination is positioned on and mounted to a foundation 118 by means of a mounting pin 116 (shown in the figure in dotted line form). A sill sealer 120 is disposed between the second tape strip 112 and the upper surface of the foundation 118. The first and second tape strips 106, 112 provide a secure, sealed connection between the structural insulated panel 100 and the 2X stick sill plate 104 and 2X stick base plate 110, respectively.

There has thus been shown an arrangement for installing structural insulated panels in a building with 2X stick construction. Each structural insulated panel includes an inner insulating core and first and second outer facings attached to opposed surfaces of the panel's inner insulating core. A strip of pressure sensitive tape, preferably of the self-adhering type, is wrapped around a 2X stick structural member and opposed ends of the tape strip are affixed to the panel's outer facing. The tape strip may extend the entire width or height of the panel to provide a tight, moisture/weather resistant seal between the panel and the structural member supporting the panel. This tape connecting approach is particularly adapted for connecting the edge of a structural insulated panel to a 2X stick structural member forming an opening in a wall such as for a window or doorway. The tape strip is easily applied, is an inexpensive building construction component, and provides a high strength, sealed connection between the panel and its support member. The invention further contemplates joining adjacent structural insulated panels in an edge-abutting manner by means of a tape strip adhesively bonded to adjacent edges of the panels. A mastic adhesive disposed between and in contact with the panels' insulating cores further strengthens the bond between the panels. The invention further contemplates a thin, strip-like filler structural insulated panel disposed between and bonded to a pair of closely spaced 2X dimensional structural members disposed about an opening such as a doorway or window. The tape strip panel connection approach may be used in combination with other panel connection arrangements such as a metal C-shaped channel attached to the edge of the panel and connected to the 2X stick structural member by screws or nails.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawing is offered by way of illustration only and not as a limitation. The actual scope of the invention is intended to be defined in the following claims when viewed in their proper perspective based on the prior art.

I claim:

1. A structural panel connecting arrangement for use in a building structure comprising:

a generally planar structural insulated panel having an inner insulating core with opposed first and second outer surfaces and first and second outer facings respectively disposed on the first and second outer surfaces of said insulating core;

an elongated, linear 2X stick structural member in the building structure; and a tape strip having a self-adhering surface disposed about and adhesively bonded to said 2X stick structural member, said tape strip including first and second opposed ends adhesively bonded to the first and second outer facings of said structural insulated panel, respectively.

2. The structural panel connecting arrangement of claim 1 further comprising second adhesive means disposed between said 2X stick structural member and an edge of said structural insulated panel.

3. The structural panel connecting arrangement of claim 2 wherein said second adhesive means includes a deposit of mastic, urethane glue or epoxy cement.

4. The structural panel connecting arrangement of claim 1 wherein said 2X stick structural member is a building structural member and wherein said building structural member is disposed adjacent and defines a portion of an opening in a building structure.

5. The structural panel connecting arrangement of claim 4 wherein said building structural member forms a plate, jamb or header of a window or a door opening in the building structure.

6. The structural panel connecting arrangement of claim 1 further comprising a generally C-shaped channel inserted in said inner insulating core and disposed in an edge of said structural insulated panel and first and second coupling means respectively connecting said C-shaped channel to said structural insulated panel and to said 2X stick structural member.

7. The structural panel connecting arrangement of claim 6 wherein said first and second coupling means includes connecting pins.

8. The structural panel connecting arrangement of claim 7 wherein said connecting pins are screws or nails.

9. The structural panel connecting arrangement of claim 6 further comprising first and second struts disposed in said structural insulated panel adjacent said C-shaped channel, wherein said first coupling means is inserted through said first and second struts and said C-shaped channel and into the insulating core of said structural insulated panel.

10. A structural panel connecting arrangement comprising:

a generally planar first structural insulated panel having an inner insulating core and first and second facings disposed on opposed outer surfaces of said insulating core;

a generally planar second structural insulated panel having an inner insulating core and first and second facings disposed on opposed outer surfaces of said insulating core, wherein said first and second structural insulated panels are arranged in edge-abutting contact;

first and second tape strips disposed over the adjacent edges of said first and second structural insulated panels and adhesively engaging the first facings and the second facings, respectively, of said first and second structural insulated panels for securely connecting said first and second structural insulated panels in a sealed manner; and first and second studs disposed in each of said first and second structural insulated panels and bonded to the inner insulating core of its associated structural insulated panel, wherein each of said first studs is disposed adjacent said first tape strip and each of said second studs is disposed adjacent said second tape strip.

11. The structural panel connecting arrangement of claim 10 further comprising an adhesive deposit disposed between and engaging the inner insulating cores of said first and second structural insulated panels for further increasing the strength of the connection between said structural insulated panels.

12. A structural arrangement disposed adjacent an opening in a building structure, said structural arrangement comprising:

a plate member and a structural member arranged in a spaced manner from one another and disposed adjacent the opening in the building structure, wherein said plate member and said structural member are comprised of 2X stick construction;

an elongated, linear filler structural insulated panel disposed between and engaging said plate and structural members, said filler structural insulated panel having an inner insulating core and first and second facings disposed on outer opposed surfaces of said insulating core and respectively engaging said plate member and said structural member;

a first tape strip disposed about and adhesively engaging said plate member, said first tape strip further disposed in contact with and adhesively engaging the first and second facings of said filler structural insulated panel; and a second tape strip disposed about and adhesively engaging said structural member, said second tape strip further disposed in contact with and adhesively engaging the first and second facings of said filler structural insulated panel.

13. The structural arrangement of claim 12 further comprising adhesive deposits disposed between and engaging said filler structural insulated panel and said plate member and said structural member.

14. The structural arrangement of claim 13 wherein said adhesive deposits are comprised of mastic, urethane glue or epoxy cement.

15. The structural arrangement of claim 12 further comprising coupling means for connecting said structural member to a window or door header.

16. The structural arrangement of claim 15 wherein said coupling means comprises connecting pins.

17. The structural arrangement of claim 16 wherein said connecting pins are screws or nails.

18. The structural arrangement of claim 12 wherein said filler structural insulated panel further comprises first and second studs disposed in said insulating core and respectively engaging the first and second facings of said filler structural insulated panel.

* * * * *

UNITED STATES PATENT AND TRADEMARK OFFICE

CERTIFICATE OF CORRECTION

PATENT NO. : 6,269,608 B1
DATED : August 7, 2001
INVENTOR(S) : William H. Porter It is certified that error appears in the above-identified patent and that said Letters Patent is hereby corrected as shown below:

Column 2,
Line 49, after "and" delete "60" and insert -- 16 --

Signed and Sealed this

Twenty-sixth Day of February, 2002

*Attest:*

*Attesting Officer*

JAMES E. ROGAN
*Director of the United States Patent and Trademark Office*